United States Patent [19]

Besson

[11] 4,063,439

[45] * Dec. 20, 1977

[54] APPARATUS FOR CALIBRATING AND SURFACING TUBES

[75] Inventor: Louis A. Besson, Romainville, France

[73] Assignee: Chabas & Besson S.A., Romainville, France

[ * ] Notice: The portion of the term of this patent subsequent to Dec. 18, 1990, has been disclaimed.

[21] Appl. No.: 615,815

[22] Filed: Sept. 22, 1975

Related U.S. Application Data

[60] Division of Ser. No. 403,628, Oct. 4, 1973, abandoned, which is a continuation-in-part of Ser. No. 193,632, Oct. 29, 1971, Pat. No. 3,779,064.

[30] Foreign Application Priority Data

Nov. 6, 1970 France ..... 70.39913

[51] Int. Cl.[2] ..... B21C 1/24; B21C 9/00

[52] U.S. Cl. ..... 72/45; 72/283; 72/284; 72/370

[58] Field of Search ..... 72/41, 43, 44, 45, 283, 72/284, 370

[56] References Cited

U.S. PATENT DOCUMENTS

| | | | |
|---|---|---|---|
| 2,197,098 | 4/1940 | Davis et al. | 75/128 |
| 2,351,710 | 6/1944 | Sanders | 72/283 |
| 2,679,925 | 6/1954 | McIlvried et al. | 72/283 |
| 3,779,064 | 12/1973 | Besson | 72/283 |

FOREIGN PATENT DOCUMENTS

| | | | |
|---|---|---|---|
| 322,558 | 6/1902 | France | 72/283 |
| 1,062,260 | 12/1953 | France | 72/283 |
| 365,266 | 12/1962 | Switzerland | 72/370 |
| 250,639 | 1/1970 | U.S.S.R. | 72/370 |

*Primary Examiner*—E. M. Combs

*Attorney, Agent, or Firm*—Keil, Thompson & Shurtleff

[57] ABSTRACT

An improvement in a process and apparatus for internal finishing and calibrating tubes is provided in which the internal surface of the tube is sprayed during the work on the tube with at least one lubricating jet directed to the work zone ahead of the passage of the tool.

4 Claims, 4 Drawing Figures

APPARATUS FOR CALIBRATING AND SURFACING TUBES

This application is a division of application Ser. No. 403,628 filed Oct. 4, 1973, now abandoned, which is a continuation-in-part of application Ser. No. 193,632 filed Oct. 29, 1971, which is incorporated herein by reference and has matured into U.S. Pat. No. 3,779,064.

BACKGROUND

In the parent application internal and/or external surfacing of tubes having as cross section any closed ring and of calibration from the inside or from the outside of said tubes is described characterized by the fact that there is used to work, a tool or mandrel of which one part at least of the external surface, harder than the metal to be worked, is defined by the displacement of a meridian curve resting on a closed directrix approximately identical with the border corresponding to the surface to be worked of the cross section of the tube. The profile of the tool along a meridian curve generating its external surface is such that, when passing from the first end plane of the tool, which corresponds to the point at which the tool enters in contact with the tube, to the second end plane of the tool, which corresponds to the plane at which the end of the contact occurs between the tool and the tube, there is made to vary in a continuous manner the distance to the axis of the tube, increasing it when work is done on the internal surface of the tube, and decreasing it when work is done on the external surface. The maximum variation of said distance is greater than the maximum depth of the faults which the tube presents on the surface to be worked on, and smaller than the value which corresponds, to insure the displacement of the tool along the axis of the tube, with a force applied on the tube which exceeds the mechanical resistance of said tube, and in that there is insured a relative displacement in translation along the axis of the tube between the above defined tool and the tube to be worked on.

In a preferred mode of operation defined in the parent application, it has been suggested to perform the calibrating and the internal surfacing of a tube having a circular section by means of a mandrel having the shape of a toric ring with a half round section. It has been indicated that, in the case when work is done on cold drawn steel tubes, the radius of the cross section of the toric mandrel had to be, for the first run of the work preferably between 3 and 6 mm, but could be more, for example, 10 mm, for the finishing run. It has also been indicated that the tube to be worked is preferably subjected to a preliminary run through a drawplate to perform a shaping of the tube. It has finally been indicated that at the time of the running of the toric mandrel inside the tube, it is necessary generally to lubricate the inside of the tube and/or the mandrel. The suggested lubricating is performed, generally, with a brush prior to the setting into place of the tube to be worked on the machine meant for the carrying out of the process.

It has now been observed that it could prove advantageous to lubricate and to cool the inside of the tube to be worked on, and the toric mandrel which performs the work in situ during the work.

OBJECTS

The present invention, consequently, has as its object a surface-finishing process and an internal calibrating process for tubes, according to the parent application, characterized by the fact that the tool, which makes possible the internal tube work, is sprayed during work on the tube by means of a lubricating jet directed on the work zone ahead of the passing of the tool.

In one preferred mode of carrying out the process according to the present invention, the lubricating agent used is a water soluble lubricating agent, the rate of flow of the lubricating agent ranges between 10 and 30 liters per minute.

It is advantageously possible to use as a water soluble oil the water soluble oil found on the market under the brand name "Wynns" used in a concentration of approximately 20% in water.

The present invention also has as its object a machine for the calibrating and the surface finishing of the inside of tubes, making it possible to use the above defined process, said machine having on one part a fixed frame or casing, on the other part a stem movable in translation on which there can be fitted a tool or mandrel such as defined in the parent application, and finally, means for holding the tube to be worked on, with respect to the frame or casing, and means which insure the displacement of the tool with respect to said tube, characterized by the fact that the stem on which the tool is fitted preferably has, internally, a duct or channel to feed the lubricating agent, which communicates with the outside of the stem by at least one boring the axis of which is directed in the direction of the work edge of the tool.

In one preferred mode of operation, the tool is fixed by screwing, for example, to the end of a carrying stem for tools, fastened to the rod of a piston of a hydraulic jack; the tool carrying stem has an external diameter slightly less than the internal diameter of the unfinished tube to be worked on; the tool carrying stem is constituted in the first place, by a head along the end axis of which there has been formed a threaded portion for the fixation of the tool, said head being perforated with several borings which are oblique with respect to the axis of the stem, distributed, for example, along the generatrices of a cone and all of them opening into a central duct or channel; in the second place, a tubular cross piece along the axis of which there is placed, preferably, a tube connected to the central duct of the head; and in the third place, by a fixation base fastened to the cross piece, which makes it possible to insure the solidarity of the tool carrying stem with the stem of the movable piston of the hydraulic jack, said fixation base optionally having running through it a tube which is connected to the central duct of the head.

The apparatus which has just been described for the tool carrying stem at the end of which the tool is placed, is especially important because the arrival of the lubricating and cooling fluid may be provided for, from a pump of the conventional type, directly on the end of the piston rod of the hydraulic jack, so that when it is necessary to change the tool carrying stem, it is sufficient to unscrew said stem to disconnect it from the piston rod, without there being any need to touch the piping through which comes the lubricating and cooling fluid.

The lubrication in the course of the work, such as just defined, in no way prevents a preliminary lubricating of the tool or mandrel prior to the start of the work on the tube. In that case, it is possible advantageously to choose as lubricating agent to apply on the tool, by immersion for example, a lubricating oil such as the one known under the name of "Tubanor A 6 N P" supplied by the French firm Rhone-Poulenc.

It has been observed, moreover, that in order to render easier the introduction of the tool into the tube to be worked on, it might prove desirable to provide for, at the intake of the tube, a chamfer which insures the perfect centering of the tool with respect to the tube.

The present invention, therefore, also has as its object a process for the surface finishing and for the internal calibrating of tubes having a circular section, such as defined above, characterized by the fact that, on the side where the introduction of the tool into the tube takes place there is provided, on the internal edge of the tube, a cone shaped chamfer which increases, at the entrance, the internal radius of the tube. In one preferred mode of operation, the intake radius of the tube is increased by 0.5 to 1.5 mm, and the angle of the cone-shaped chamfer, with respect to the axis of the tube, ranges between 10° and 20°.

It has been observed that the process according to the present invention makes it possible to obtain especially advantageous results for cylindrical tubes of steel, the wall thickness of which ranges between 8 and 16% of the internal diameter. It has been indicated, in the parent application that it was advantageously possible to cause the tubes to be worked on to undergo, in a drawplate, a shaping up, then a passage of the toric tool for surface finishing and for calibrating, and finally a passage of a second toric tool which insured the finishing. It has now been observed, moreover, that in that case, the best results were obtained when the passing of the tool in the finishing phase gave the tubes a diameter increase ranging between 0.10 and 0.25 mm, approximately.

The present invention, therefore, has as its object a process such as defined above, applied to cylindrical tubes of steel having a circular section, characterized by the fact that the thickness of the walls of said tubes ranges between 8 and 16% of the initial internal diameter of the tubes.

In one preferred mode of operation of the above defined process, which includes a shaping in a drawplate, a first passage of the toric shaped tool, and a second passage, called finishing passage, of the toric shaped tool, the increase in internal diameter of the tube, during the finishing passage, ranges between 0.10 and 0.25 mm.

In the parent application it has been indicated that the too was limited, for at least part of its external surface, by a revolution surface such that the angle formed with the axis by the straight line which joins the point at which the tool comes in contact with the tube, and the corresponding point at the end of the contact of the tool with said tube, approximately ranges between 12° and 20°. In the case when a tool is used with a toric external surface with a circular section, it has been found to use a torus radius ranging between 3 and 6 mm for the first work passage, and a greater radius 10 mm, for example, for the finishing passage. The radius of the torus section which seemed to be the best suited for the work in first passage had been indicated, in the example of operation, as being 4 mm. It has been observed that the radius of the cross section of the torus which corresponds to the optimum could vary as a function of the heterogeneity of the metal of the tube to be worked on. In the case when the tube is a welded tube having a welding line where there may be found hard grains spread throughout a less hard metal, the use of a torus with too small a section radius may lead to tearings of the metal along the heterogeneity line. In order to prevent those tearings, it has been observed that it was especially important to increase the radius of the cross section of the torus, the optimum range being between 5 and 7 mm, approximately. Good results have been obtained on electrically welded tubes, using a torus with a radius of 6 mm.

The present invention therefore has as its object a process for the surface finishing and for the calibrating of cylindrical tubes of steel having a circular section and which have a zone of heterogeneity, for example, a soldering or welding line, said process being such as above defined, and making use of a tool having a toric shaped external surface with a circular cross section, characterized by the fact that the radius of the circular cross section of the torus of the tool ranges between 5 and 7 mm for the first passage tool and, preferably, is equal to 6 mm.

It has also been observed that it was advantageous, in order to obtain a perfect surface finishing of the tube, to increase the hardness of the tool or mandrel which works on the tube. From this point of view, good results have been obtained by using, for the composition of the tool, alloyed steels subjected to a thermal treatment so that they have a Vickers hardness of more than 800, but results are even better when there are used as tools toruses made of annealed tungsten carbide. Of course, the tool has a life which is the longer as its hardness is farther removed from the hardness of the tube to be worked on.

The present invention therefore has as its object a machine for carrying out the process such as defined above, for the surface finishing and for the calibrating of the inside of mild or of semi-hard steel tubes, characterized by the fact that the tool is made of hard treated steel which possibly has been alloyed, or of tungsten carbide.

In one preferred mode of operation, when the tool is made of hard alloy steel, the thermal treatment is performed to obtain a surface hardness which is greater than 800 Vickers; the steel contains from 0.7 and 9.9% of carbon, and from 15 to 20% of tungsten; or the steel contains 0.8% of carbon; 18% of tungsten, 4.7% of chromium, 1.15% of vanadium, and 0.7% of cobalt.

It has therefore been observed that, in the case when there was a danger of tearing of metal because of a heterogeneity in one zone of the tube, the increase in hardness of the tool made it possible to improve results. However, it has also been found that an improvement could be obtained in the same case by reducing the speed of displacement of the tool inside the tube. In the case when the internal surface finishing and the calibrating are performed on tubes of semi-hard steel or of mild steel, it is possible advantageously to use a speed of displacement of the tool inside the tube ranging between 1 and 2 meters per minute and, preferably, a speed of displacement close to 1.50 meters per minute. On the contrary, when the tube presents a zone or a line of heterogeneity, as is the case for electrically welded tubes, it proves advantageous to lower the speed to a range of 0.50 meter per minute to 1.50 meters per minute, and preferably to a speed of 1 meter per minute.

The present invention therefore has as its object a process such as defined above, used for the internal surface finishing and calibrating of steel tubes, characterized by the fact that the speed of displacement of the tool, with respect to the tube, ranges between 0.5 and 2 meters per minute.

In one preferred mode of operation, when the tubes have a zone of structure heterogeneity, the speed of displacement of the tool with respect to the tube ranges between 0.5 and 1.5 meters per minute and, preferably, it is near 1 meter per minute.

It is suitable to mention that there exists an interaction for the work on a same steel tube, between the optimum speed to use for the displacement of the tool with respect to the tube, and the ratio chosen between the hardness of the tool and the hardness of the tube.

As indicated in the parent application, there is generally used a preliminary passage through a drawplate to obtain a shaping, the importance of which is first of all a function of the state of the internal surface of the unfinished tube on which it is desired to work. For a tube the internal surface of which is in a relatively mediocre state, it is possible advantageously to choose a theoretical shaping of 0.75 mm, the value of said shaping also having to take into account, when it is desired to work on a series of tubes, the tolerance which exists on the external diameter of the tubes to be worked on, so that it will be possible, with the same drawplate, to apply a sufficient shaping for all of the tubes in the series.

The present invention therefore also has as its object a process such as defined above, in which there is used a preliminary passage of the tube through a shaping drawplate, characterized by the fact that the shaping of the tube decreases the external diameter of the tube by a value ranging between 0.5 and 1 mm, approximately.

The use of a preliminary passage through a drawplate brings about the necessity of setting the drawplate into place at the time of said passage, and of removing it in the phase which corresponds to the internal work on the tube. Said handling of the drawplate is greatly eased by placing, according to the present invention, the drawplate in a support mounted in a pivoting manner with respect to the frame or casing, the axis of pivoting being approximately parallel to the direction of displacement of the tool of the machine, one of the extreme positions of the support corresponding to the complete disappearance of the drawplate away from the axis of work of the tool and the other extreme position, set by a lug piece, corresponding to the setting into place of the drawplate for the preliminary passage through said drawplate.

For the passage through the shaping drawplate, the speed of displacement of the tube with respect to the drawplate preferably is appreciably lower than the speed which has been advocated above for the displacement of the tool with respect to the tube. Especially, in the case when the machine which makes it possible to carry out the process according to the present invention includes a double action hydraulic jack which in one direction insures the passage of the tube through the shaping drawplate and, in the other direction, insures the passage of the tool inside of the tube which has first been shaped, it is arranged, according to the present invention, to choose for the section of the piston of the jack, a surface which is approximately double the section of the piston rod. In that case, for a constant rate of flow of the hydraulic group, the speed of displacement of the piston in the direction of the passage through the drawplate shall be half the speed of displacement of the piston in the direction of the passage of the tool through the tube.

The present invention, therefore, also has as its object a process such as defined above, which includes a preliminary passage of the tubes through a shaping drawplate, characterized by the fact that the passage through the drawplate takes place at a speed ranging between 0.25 and 1 meter per minute, approximately.

Finally, it has been observed that it was necessary to maintain a uniform displacement of the tube, with respect to the shaping drawplate, or of the tool with respect to the tube. Since the internal diameter of the tube to be worked on may undergo slight variations over the whole length of the tube, and since the effort for the forward motion of the tool in the tube is not of necessity strictly constant, it is suitable, in order to insure a progressive continuous displacement of the piston of the jack of the machine used, to place, on each one of the pushing chambers of said jack, a counter-pressure valve which, at the time of the entrance of the pushing fluid into the jack, will offer no restriction to the entrance of said fluid but which will offer such a restriction, by means of a diaphragm, for example, at the time of the exit of the fluid. Said dispostion makes it possible to render more uniform the displacement of the piston of the jack, in spite of the variation of the resistance in the course of the work.

The present invention therefore has as its object a machine, for the purpose of carrying out a process of internal surface finishing and of calibration of tubes, such as above defined, said machine including a double action hydraulic jack which makes possible, in the one and in the other direction, to push the tube through a drawplate for shaping and, in the other direction, to pull the tool inside the tube in order to increase the latter's diameter while calibrating it and while internally finishing its surface, characterized by the fact that on each pushing member, on each side of the piston of the jack (double action jack), there has been placed a check valve which lets the pushing fluid enter freely but which restrains the speed of exit of said fluid.

In order to better help understand the objects of the present invention, there will now be described, as examples which in no way are limitative, several modes of operation represented in the drawings.

THE DRAWINGS

BRIEF SUMMARY OF THE INVENTION

Figure 1:
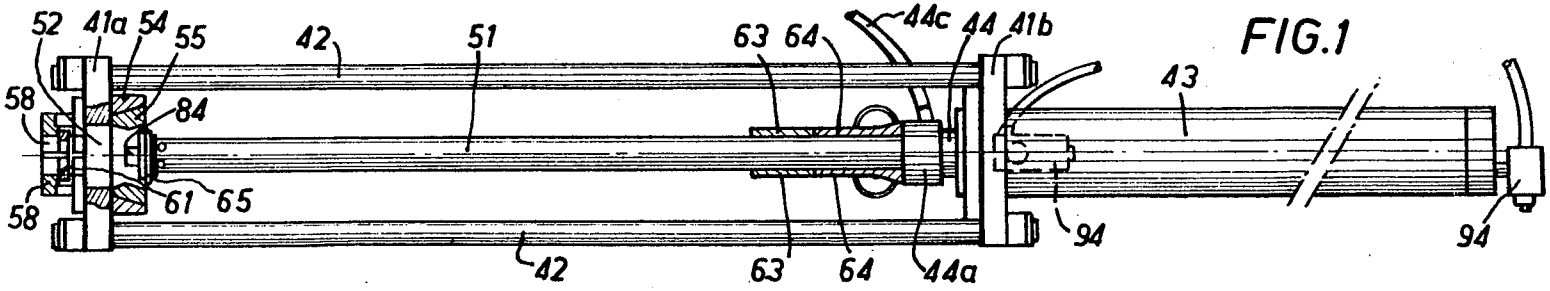
FIG. 1 represents a plan view of a machine according to the present invention, usable for the operation of the process of the process of calibrating and surface finishing of steel tubes, with a preliminary passage through a shaping drawplate.

The invention provides an improvement in a process and apparatus of the type described in the parent application for internal finishing and calibrating tubes in which the internal surface of the tube is sprayed in situ during the work on the tube with at least one lubricating jet directed to the work zone ahead of the passage of the tool.

DETAILED DESCRIPTION OF THE INVENTION

Referring to the drawing, it is seen that there have been designated by 41*a* and 41*b* two porticoes, separated by 1.45 meters, approximately, and connected together by 4 rigid rods 42 which form a parallelepipede with a square base. The whole constituted by porticoes 41*a*, 41*b* and by rods 42 constitutes the frame of the machine. Said frame carries a double action hydraulic jack 43, a jack the moveable piston of which has been indicated by 44 and the axis of which is placed, approximately, in the same direction as the axis of the parallelepipede having a square base, formed by rods 42. The run of the jack is approximately 1.20 meters.

Hydraulic jack 43 is fed by a motor pump which is not represented in the drawing. The operation of jack 43 is obtained by means of a distributor (not shown) which the user controls by means of a handle. The rate of flow of the motor pump fluid is 7.85 liters per minute and the section of the piston of the jack is 122.71 square centimeters, while the section of the piston rod 44 is 50.27 centimeters square. The operating pressure of the jack ranges between 100 and 180 atmospheres approximately. There is obtained a speed of displacement of the piston rod 44 of 1.084 meters per minute from the left to the right in FIG. 1, and of 0.64 meter per minute from the right to the left in FIG. 1.

Rod 44 of jack 43 carries at its end a connection tip 44*a* which has an internally threaded boring where it is possible to screw the threaded end of a tool carrying stem 51. Tip 44*a* laterally has a piping 44*b* on which there is affixed a flexible duct 44*c*. Piping 44*b* is connected with the inside of the boring, inside which there is screwed the tool-carrying stem 51. The diameter of rod 51 is slightly less than the diameter of the tube which it is desired to calibrate and to surface finish the inside by means of the machine according to the present invention. Facing the free end of the tool carrying stem 51, which is placed along the axis of jack 43, there is formed in portico 41*a* an opening 52. Forward from portico 41*a*, on the side where there is located jack 43, there has been placed a drawplate support 54 which can move in the transverse direction in the the zone limited by the four rods 42. The drawplate support 54 is mounted in a pivoting manner on a shaft carried by portico 41*a* said shaft being parallel with rods 42. The transverse pivoting motion of support 54 is obtained by operating a handle and it makes it possible for said support 54 either to open up opening 52 between two rods 42, or to come to the position of work represented in FIG. 1, then taking its support on a lug piece solidary of portico 41*a*. Said arrangement makes possible a fast maneuver of support 54 of the drawplate.

Drawplate support 54 has in its central zone a cone shaped hollowed out part inside which there has been placed a drawplate 55 the external shape of which is a cone, of which the angle at the summit corresponds to the conicity of the central cone shaped hollowed out area of the drawplate support 54. Drawplate 55 has a shape identical to that which has been described for drawplate 15 in the parent application. It is made of "Sancy" type steel, subjected to a thermal treatment to have a rupture limit of 200 kg/mm$^2$. Said steel contains 1.70% of carbon, 13% of chromium, 0.50% of molybdenum, and 0.50% of tungsten.

On the side of portico 41*a* where there is not located the drawplate support 54, there are placed two movable jaws 58, each one of them movable around an axis parallel with the longitudinal axis of the machine. Jaws 58, when they are in the closed position, limit between them a cylindrical hollowed out part. They have in the median part of their thickness a groove inside which there has been placed a bronze segment 61. When jaws 58 are in the closed position, the two segments 61 of bronze are in a position of support on stem 51 when the latter is in a position forward enough to be at a right angle with jaws 58.

In order to execute the calibrating and the surface finishing of a tube, said tube is placed on stem 51 by making it slide on that stem through opening 52. At that time, piston 44 of jack 43 is placed in its position the most remote from portico 41*a*. Between piston 44 and the tube, there have been placed on stem 51 for one thing a ring 63 which approximately has in diameter the dimensions of the tube end, for the other thing, two half shells 64 which approximately result from the sawing of a ring 63 along an axial plane. There is then caused, by acting on the distributor associated with jack 43, a forward motion of piston 44 after there has been placed the drawplate support 54 and its drawplate 55, in the position represented in FIG. 1. The tube pushed by the frontal face of ring 63 then runs through drawplate 55.

There have been recorded, in the third and fourth columns of Table I, the results obtained after the running through a drawplate for tubes of different diameters and made of different qualities of steel. It is observed that, depending on the diameters and on the steel qualities, the real shaping of the internal diameter of the tube is more or less important. All of the shapings obtained a range between 0.5 and 1 mm.

The advantages of this preliminary passage through a drawplate for shaping have been indicated in detail in the parent application.

When piston 44 of jack 43 has covered a sufficient run, the tube carried by stem 51 escapes from drawplate 55 and it continues its forward motion. At that moment, jaws 58 still are open. There are then removed the two half shells 64, leaving between the tube to be worked on and the tip 44*a*, only ring 63, and pushing said ring back toward the piston of the jack. When the piston has moved forward in a sufficient manner, the rear part of the tube to be worked on reaches beyond jaws 58, the end of stem 51 nevertheless being beyond the fore part of the tube. At that moment, the jaws 58 are closed in a manner such that segments 61 come into contact with stem 51, in the rear of the tube to be worked on. The internal diameter of jaws 58 is less than the external diameter of the tube to be worked on.

Figure 2:
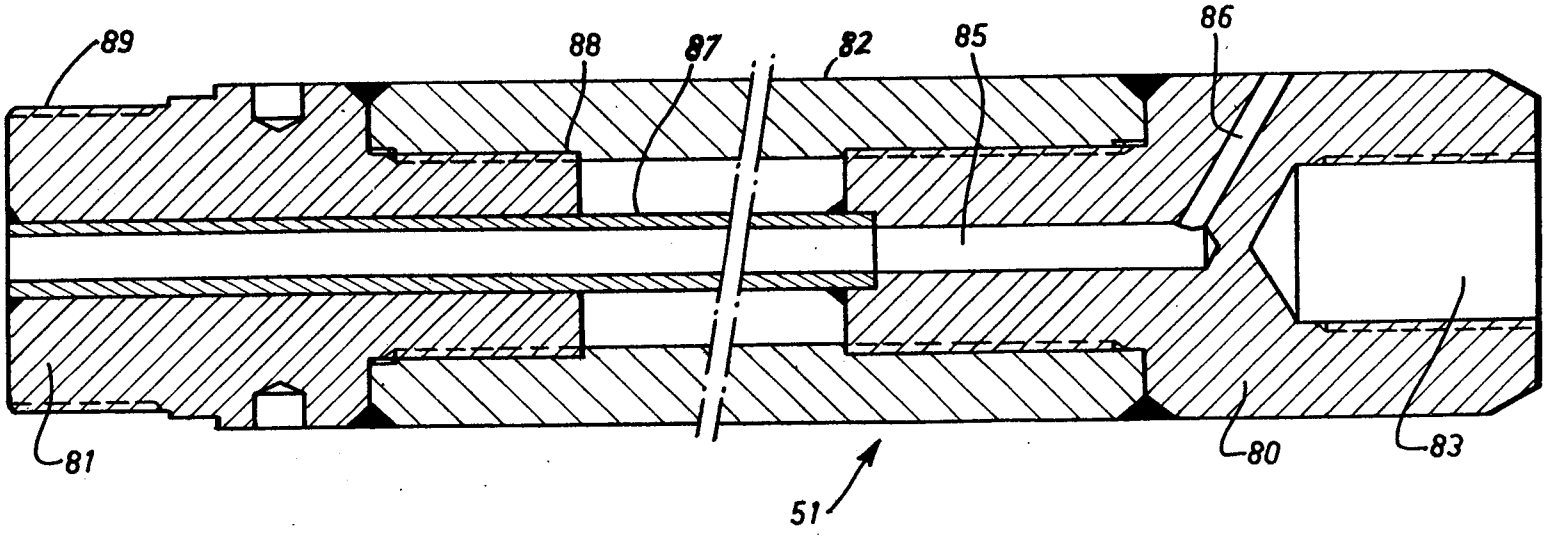
FIG. 2 represents, in section, the detail of the tool carrying stem, connected to the rod of the jack's piston.

With reference now to FIG. 2, it can be seen that the tool carrying stem 51 consists of three parts made solidary of one another. At one end there is a head 80, at the other end there is located a fixation base of seating flange 81, and between them there is placed a tubular cross piece 82. Head 80 bears, on its end face, an internally threaded boring 83, where there comes to place itself a screw 84 (FIG. 1) the head of which tightens against the end of head 80 a torus-shaped tool indicated as a whole by 65 (FIG. 1). On the side of head 80, which has no boring 83, there has been formed a central duct 85 into which there open six borings 86, evenly distributed around the axis of head 80 along the generatrices of a cone having 60° as its half angle at the summit.

In the zone where central duct 85 opens to the outside of head 80, there is welded a tube 87 which is placed approximately along the axis of the cross piece tube 82. Cross piece tube 82 is then assembled to head 80, and there is presented, at the other end of cross piece tube 82, the base of flange 81 which has, along its axis, a boring which allows for the passage of tube 87.

Base of flanged end 81 is screwed inside cross piece 82 by means of threading 88 and when solidarization has been completed, tube 87 is welded on the end face of base or flange 81.

Base of flanged end 81 includes an external thread 89 which makes it possible to screw it inside the threaded boring which is in tip 44*a*, so that, when stem 51 is assembled on tip 44*a* as already described, the flexible piping 44*c* can feed liquid lubricant to tube 87, to the central duct 85 and to the borings 86. There is used, to feed these borings 86, a water soluble oil sold under the trade name of "Wynns", at a concentration of 20% in water, and with a rate of flow of 20 liters per minute.

Figure 4:
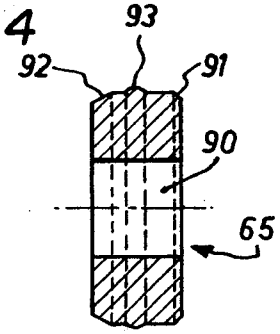
FIG. 4 represents, in section, the tool used for the calibrating and for the surface finishing of the inside of the tubes.

Tool 65, which is affixed by means of screw 84 to the end of head 80 of the tool carrying stem 51, has been represented in detail in FIG. 4. Said tool is made of "high speed" steel subjected to a thermal treatment, so as to have a Vickers hardness of 890, approximately. The steel used contains 0.8% of carbon, 18% of tungsten, 4.70% of chromium, 1.15% of vanadium, and 0.70% of cobalt. It appears in the form of a thick washer having a central boring 90 which makes possible the passage of screw 84 the head of which blocks the tool at the end of head 80 of the tool carrying stem 51. The face of the tool which is located near stem 51 has a chamfer 92 with a 30° half angle at the summit, said chamfer having a width of 7 millimeters. On its other face, tool 65 has a chamfer 91 with a 45° half angle at the summit, and a width of 2 mm. The zone of the tool which works on the inside of the tube is torus 93 the section of which is constituted by the arc of a circle. For the tool which corresponds to the first passage inside the tube, the radius of the arc of circle is 4 millimeters for steel tubes drawn under cold conditions, without any welding, and it is 6 millimeters for the steel tubes which have a welding line. For the tools which correspond to the work in the second passage, the radius of the arc of circle is approximately 10 millimeters.

Once there has been placed at the end of stem 51 a tool 65 such as the one above described, which corresponds to the work of a first passage, there is caused the displacement of piston 44 from the left toward the right in FIG. 1. Tool 65 is centered in chamfer 92, inside the tube to be worked on. In order to improve the centering, it is provided to practice in the internal border of the tube a chamfer having a 15° half angle at the summit, and which widens the entrance diameter of the tube by 2 millimeters. The tool then moves inside the tube, and the torus 93 causes a calibrating and a surface finishing, as indicated in the parent application. The results obtained after the passage of tool 65 through the tube are recorded in columns 5 and 6 in Table I.

The figures, which are recorded in Table I, correspond to electrically welded tubes and to a speed of displacement of the tool, with respect to the tube, which was approximately 1 meter per minute. However, it would be possible to increase that speed, when treating tubes which do not have any line of heterogeneity (soldering or welding line). The sprinkling of soluble oil through borings 86 which are directed toward tool 65, is done during the entire work period on the tube performed by the tool, as indicated above. It can be seen that there exists a difference between the internal diameter of the tube after the passage of the tool, and the maximum external diameter of the tool said difference being variable as a function of the dimensions of the tubes and of the quality of the steel of the tube.

Of course, it is desirable to lubricate torus 93 prior to its introduction into the tube, by means of an application by soaking of an oil of the "Tubanor A6NP" type, supplied by the firm Rhone Poulenc Once a tool 65 has run the whole length of the tube, the tube escapes from the machine, and jaws 58 are opened. Screw 84 is unscrewed in order to release tool 65 and said tool is replaced by a similar tool, the torus 93 of which has a section, the arc of circle of which corresponds to a radius of 10 millimeters. There is again performed, after stem 51 has been brought back toward the left in FIG. 1, a passage of the tool through the inside of the tube. That second passage, called the finishing passage, is performed with a torus 93 of which the maximum external diameter is greater than the maximum external diameter of torus 93 of the tool corresponding to the first passage. Spraying through borings 86 takes place as in the course of the first passage. The results relative to that second passage of the tool are recorded in columns 7 and 8 of Table I. The diameters of the drawplate and of the two tools used in succession have been chosen for all of the examples in Table I so as to bring the tubes back to approximately the internal diameter which they had to start with.

It will be seen that the tubes which are thus treated are calibrated with an accuracy of 0.02 mm on their internal diameter, and that they have a perfectly polished internal appearance. It is thought that the surface state which is thus obtained is better than 0.5 micron. All of the imperfections which were initially present inside the tube have disappeared.

Figure 3:
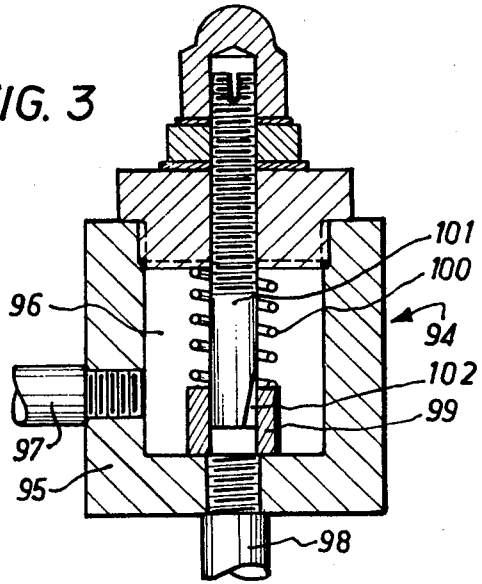
FIG. 3 represents, in section, the detail of a device which makes it possible to regulate the movement of the piston of the jack.

In order to insure a uniform displacement of the tool in the tube, and of the tube in the drawplate, there has been associated with each one of chambers of the double action jack 43 a counterpressure check valve indicated by 94 in its whole. Check valve 94 is represented in detail in FIG. 3. It includes a body 95 inside which there is formed a boring 26, into which there penetrate two ducts 97 and 98. Duct 98 is connected to the pump, duct 97 is connected to the push chamber of the jack. At the point where duct 98 opens into boring 96, there is placed a ring 99 pushed in the direction of boring 98 by means of a spring 100. A central shaft 101 runs through ring 99 and its position in height inside said ring is adjustable. Central shaft 101 approximately occupies the whole central zone of ring 99, but there has been provided for a slanted trench 102 which allows the passage of the fluid between the central shaft 101 and ring 99, said passage being the more important as the central shaft 101 is less deeply pushed into ring 99. The adjusting of the apparatus is done by working on the pushing of shaft 101 into ring 99. When the pushing fluid reaches apparatus 94 by means of duct 98 it lifts rings 99 by compressing spring 100 and it enters without any hindrance into the corresponding push chamber of the jack. On the contrary, when the fluid is pushed back outside the push chamber of the jack, it enters into the apparatus through duct 97 and it can be ejected through duct 98 only after it has run through trench 102 which constitutes a diaphragm and which consequently limits the speed of ejection of the fluid. There is thus created inside the jack chember which does not cause the push, a counterpressure which prevents jerks in the displacement of the tool. That disposition makes it possible greatly to improve the quality of the surface finishing and of the calibrating obtained by means of the machine according to the present invention.

It is of course understood that the modes of operation which have been described above are in no way limitative, and that they can be subject to any desirable modification, without departing from the scope of the present invention.

TABLE I

| 1 Size of Tubes in mm. Internal diam./ External diam. | 2 Rupture limit of the steel of tube in kg/mm² | 3 Diameter of the neck of the drawplate in mm. | 4 Internal Diameter of tube after drawplate in mm. | 5 Diameter of torus shaped tool, 1st passage - mm. | 6 Internal Diameter of tube after 1st passage in mm. | 7 Diameter of torus shaped tool, 2nd passage in mm. | 8 Internal Diameter of tube after 2nd passage in mm. |
|---|---|---|---|---|---|---|---|
| 60,325/69,85 | 40 | 69,25 | 59,65 | 60,10 | 60,13 | 60,35 | 60,30 |
| | 52 | 69,25 | 59,75 | 60,27 | 60,18 | 60,44 | 60,30 |
| 69, 85/82,55 | 40 | 81,80 | 68,90 | 69,65 | 69,69 | 69,90 | 69,83 |
| | 52 | 81,80 | 69,20 | 69,86 | 69,76 | 70,00 | 69,83 |
| 82, 55/95,25 | 40 | 94,70 | 81,62 | 82,21 | 82,23 | 82,58 | 82,52 |
| | 52 | 94,70 | 81,84 | 82,50 | 82,38 | 82,66 | 82,53 |
| 76, 20/95,25 | 40 | 94,40 | 75,35 | 76,04 | 76,02 | 76,26 | 76,29 |
| | 52 | 94,40 | 75,60 | 76,04 | 75,93 | 76,26 | 76,15 |

The invention is hereby claimed as follows:

1. In a calibrating and surfacing machine for tubes having a fixed frame, means for holding a tube on said frame, an internal tool carrying stem for said tube mounted from said frame for movement internally with respect to said tube, a tool removably fixed to one end of said stem for working the internal surface of said tube, said tool having a working surface which is limited for part of its external surface at least by a surface of revolution with a profile which increases in a constant manner from a first end plane of the tool, which corresponds to the point of entry into contact of the tool with the tube, to a second end plane of said tool, which corresponds to the place at which the contact of the tool with the tube ends, with a maximum depth from said point of entry to the point where the contact of the tool with the tube ends greater than the maximum depth of the defects on the interior surface of the tube but small enough to insure displacement of the tool along the axis of the tube by a force which does not exceed the mechanical resistance of the tube, a piston movable axially with respect to said tube, the improvement comprising means including an externally threaded flanged end on said tool carrying stem removably connecting an outer end of said piston with the end of said stem opposite the end removably fixed to said tool, means forming an internal passageway running axially through said stem from said flanged end and terminating internally of said stem adjacent the point where said tool is attached, one or more passageways extending outwardly from said internal passageway to the surface of said stem adjacent said tool and means to introduce a lubricant into said internal passageway at said flanged end of said tool carrying stem.

2. A machine as claimed in claim 1 in which said stem has an internally threaded passageway at one end to receive means for fastening said tool to said stem, and an internal passageway in the form of a tube which extends from an outer end of said externally threaded flanged end through said flanged end of said stem and is connected to said passageways in the end to which the tool is attached, said externally threaded flanged end and said tool receiving end being connected together axially by a tubular cross piece which is concentrically disposed around said tube.

3. A machine as claimed in claim 2 in which inner portions of said externally threaded flanged end and said tool receiving end are flanged to receive said cross piece.

4. A machine as claimed in claim 1 wherein the tool carrying stem has an external diameter which is slightly smaller than the internal diameter of the unfinished tube to be worked on.

* * * * *